United States Patent [19]

Dickey

[11] Patent Number: 5,045,140

[45] Date of Patent: Sep. 3, 1991

[54] ULTRA HIGH SPEED LABELING APPARATUS AND METHOD

[75] Inventor: Daniel M. Dickey, Denair, Calif.

[73] Assignee: CMS Gilbreth Packaging Systems, Inc., Trevose, Pa.

[21] Appl. No.: 345,447

[22] Filed: Apr. 28, 1989

[51] Int. Cl.[5] ..... B65C 3/16; B65C 9/04; B65C 9/22

[52] U.S. Cl. ..... 156/215; 118/231; 118/249; 118/259; 118/261; 156/448; 156/458; 156/566; 156/568; 156/578; 156/DIG. 13; 156/DIG. 26; 156/DIG. 34

[58] Field of Search ..... 156/215, 448, 458, 566, 156/568, 678, DIG. 13, DIG. 26, DIG. 31, DIG. 34, DIG. 35; 118/247, 231, 249, 259, 261

[56] References Cited

U.S. PATENT DOCUMENTS

| | | | |
|---|---|---|---|
| 1,575,924 | 3/1926 | McGirr | 156/568 |
| 2,703,660 | 3/1955 | Hofe et al. | 156/566 |
| 3,126,309 | 3/1964 | Manas et al. | 156/566 |
| 3,294,060 | 12/1966 | McIntyre et al. | 118/261 |
| 3,618,743 | 11/1971 | Benatar et al. | 198/384 |
| 3,717,239 | 2/1973 | Carter | 198/374 |
| 3,762,365 | 10/1973 | Herzog | 118/212 |
| 3,779,829 | 12/1973 | Wolff | 156/361 |
| 3,867,233 | 2/1975 | Eder et al. | 156/571 |
| 4,085,839 | 4/1978 | Crawford | 198/410 |
| 4,343,260 | 8/1982 | Yajima et al. | 118/204 |
| 4,357,370 | 11/1982 | Alheid | 427/211 |
| 4,385,960 | 5/1983 | Zodrow et al. | 156/568 |
| 4,561,377 | 12/1985 | Youngkeit | 118/259 |
| 4,574,020 | 3/1986 | Fosnaught | 156/80 |
| 4,662,965 | 5/1987 | DiFrank et al. | 156/215 |
| 4,693,210 | 9/1987 | DiFrank | 118/231 |
| 4,714,515 | 12/1987 | Hoffman | 156/450 |
| 4,718,373 | 1/1988 | Zodrow | 118/262 |
| 4,781,785 | 11/1988 | Szeremeta | 156/448 |

OTHER PUBLICATIONS

Manufacturer's Brochure, Trine Model 5500 G/S Contour Labeling Machine, (No Pub. date).

*Primary Examiner*—Michael Wityshyn
*Attorney, Agent, or Firm*—Morgan & Finnegan

[57] ABSTRACT

An apparatus and method for high speed placement of labels onto containers by a continuous motion. The label stock is transferred to a rotary vacuum drum, carried by rotation of the vacuum drum to a glue application station and then to a label application station where the glue coated labels are wrapped onto containers. As the containers reach the labeling position they are already rotating so that their surfaces are moving at the same speed as the drum surface. The labeled containers are then discharged onto a conveyor where they are held against rotation and stabilized by a pair of parallel belt drives.

Glue is imprinted onto each label by a roller with a patterned surface. The roller picks up glue as it rotates past a glue bar surface which emits glue from a tapered exit. The tapered configuration causes build up of suitable pressure so as to force the glue into the pattern on the glue roller. A downstream edge of the glue bar surface acts as a doctor to spread and wipe off excess glue. The excess glue collects in a hollow adjacent to the edge, and may be recirculated.

14 Claims, 3 Drawing Sheets

ULTRA HIGH SPEED LABELING APPARATUS AND METHOD

BACKGROUND OF THE INVENTION

1. FIELD OF THE INVENTION

The invention relates to apparatus and methods for continuous high speed wrapping of labels onto upright containers.

2. PRIOR ART

Mechanical handling of containers for label application normally includes a number of components integrated to operate as a unit for wrapping a label onto a container. Such apparatus, as disclosed in U.S. Pat. No. 4,242,167, may include a means of label stock supply, a means for cutting label segments, an adhesive assembly for applying adhesive or glue to label segments, a vacuum drum for transfer of the label segments to a position where they are wrapped onto a container, and means for feeding containers to and away from the labeling position. Speed limitations of any one subcomponent have been found to limit the speed of the overall operation. The apparatus of U.S. Pat. No. 4,242,167 is designed to operate at a speed of approximately 100 containers per minute.

It has been discovered that adhesive application methods used in prior apparatus do not accommodate a high speed labeling operation. A glue roller/glue bar assembly is commonly used for imprinting a glue pattern onto labels. As disclosed in U.S. Pat. No. 4,104,845, hot melt adhesive is channeled from a reservoir through a passageway inside a glue "bar". The passageway terminates in a glue deposit portal on the surface of the glue bar, in face-to-face contact with the roller. Glue deposited onto the roller surface becomes increasingly difficult to spread and drain. Excess glue results in uneven, messy printing. In addition, when the apparatus is operated at a speed exceeding 600 containers per minute, the glue may fling off the roller.

Another significant disadvantage of the prior art is that the overall speed of a labeling operation is limited by the discharge conveyor. The rate of discharge must be adjusted to accommodate spinning and instability of exiting containers. As shown in U.S. Pat. Nos. 3,765,991 and 3,834,963 conventional apparatus discharges containers between a single belt positioned opposite a stationary wall. This design, however, imparts additional instability to exiting containers and does not permit container discharge in excess of 600 containers per minute.

It is the object of this invention to achieve high speed labeling of containers by overcoming the disadvantages of the prior art.

It is another object of this invention to avoid such disadvantages by providing an apparatus and method which places labels on containers at high speeds while efficiently spreading and draining glue.

Another object of this invention is to enable a high speed labeling operation by stabilizing exiting containers in order to operate the discharge conveyor at high speeds.

It is a further object of this invention to prevent instability during discharge in order to enable operation at speeds of 1000 or more containers per minute.

SUMMARY OF THE INVENTION

The present invention is directed to a labeling apparatus and method which, in novel fashion, adapts conventional components for high speed continuous placement of labels onto containers. To achieve the objective of applying labels directly onto cylindrical containers at a rapid rate, this invention improves the speed and efficiency of glue application and facilitates rapid container exit by stabilizing container discharge.

The glue application assembly includes means for depositing glue onto a glue roller by a specially designed glue bar which has a tapered glue deposit portal, a trailing edge which acts as a glue wiper, and a hollow groove adjacent the edge which collects excess glue. The taper of the deposit portal, in conjunction with rotational forces of the glue roller, creates sufficient pressures to force glue into grooves between knurls on the roller surface. This allows for rapid rotation of the glue roller and high speed labeling. Glue deposited through the tapered glue portal is spread into an even layer by a lip-like trailing edge on the glue bar while excess glue is collected in the hollow next to the trailing edge.

Stabilizing and rapid discharge of labelled containers are achieved through the use of two parallel belts positioned on opposite sides of a discharge conveyor. The belts address the sides of the spinning containers to dampen rotation and prevent container instability along the discharge conveyer.

According to the invention, these features permit the apparatus to function at a high rate of label application.

BRIEF DESCRIPTION OF THE DRAWINGS

A preferred embodiment of the invention is shown in the drawings wherein.

DETAILED DESCRIPTION OF PREFERRED EMBODIMENTS

Figure 1:
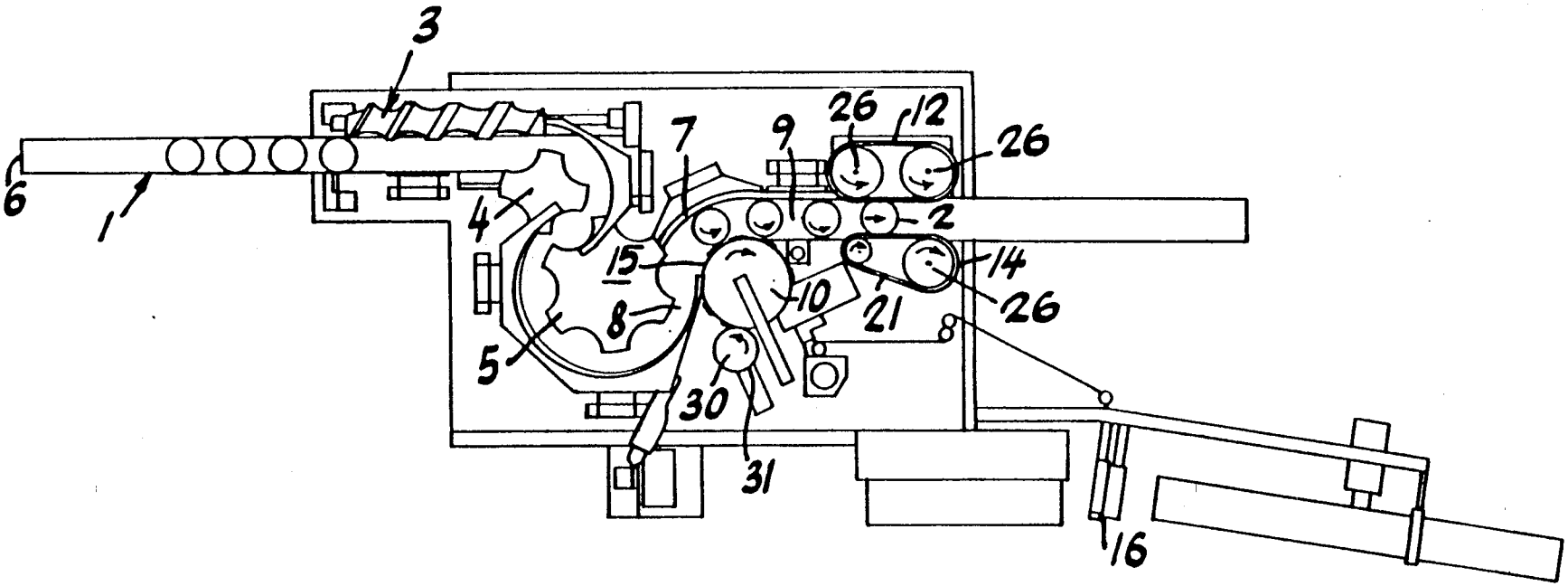
FIG. 1 is a top plan view of the apparatus.
Figure 2:
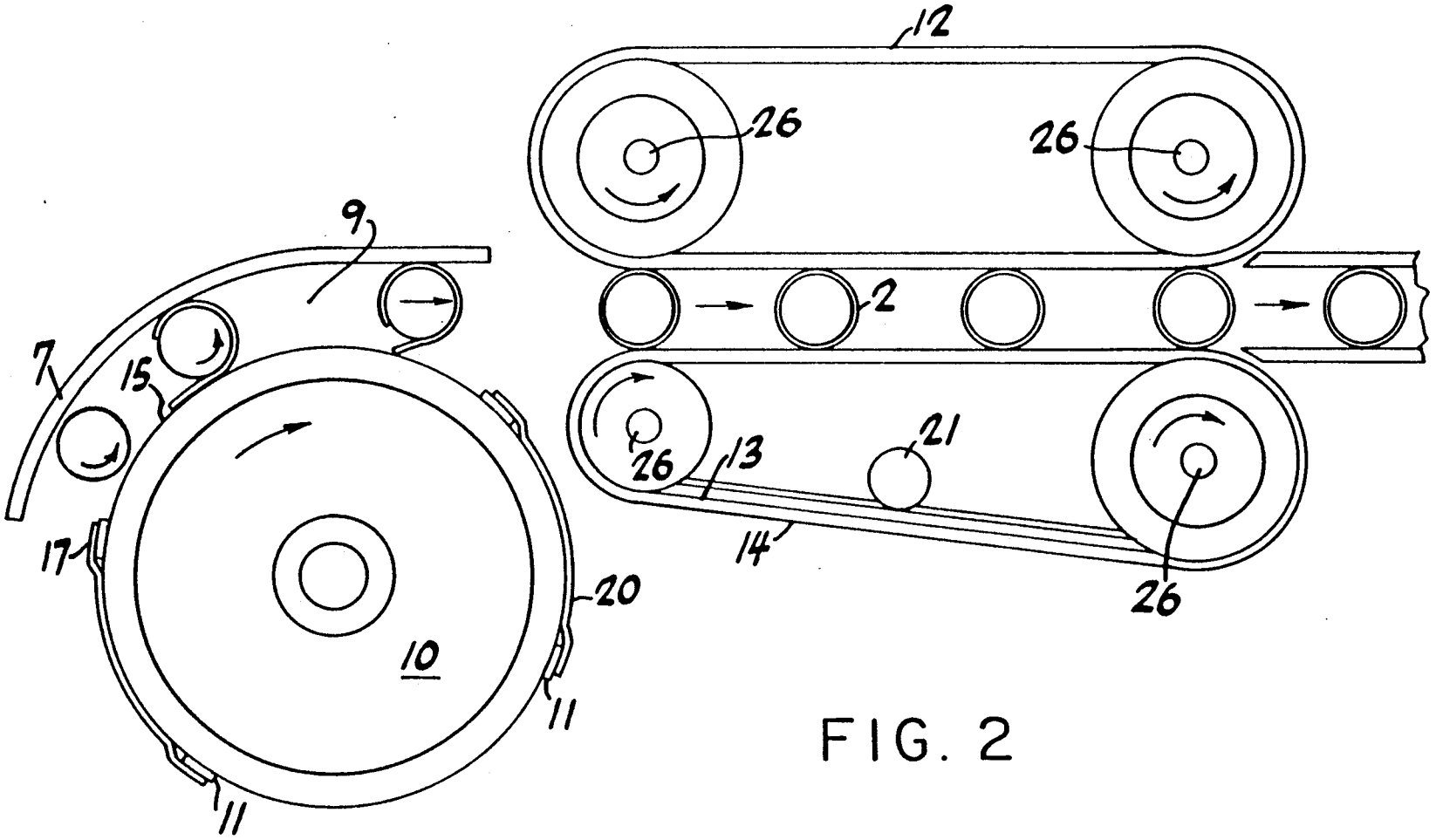
FIG. 2 is an enlarged top plan view of the discharge conveyor and stabilizer belts.

The invention may be further understood by detailed reference to the drawings. As shown in FIGS. 1 and 2, unlabeled containers 1 are conveyed on feed conveyor 6 toward labeling position 15 by a feed screw 3 and two tangentially disposed star wheels 4 and 5. Containers 1 travel freely along conveyor 6 and are carried loosely in the notches of star wheels 4 and 5, along an S-shaped path.

As each container 1 begins its exit from main star wheel 5, it advances between roll on pad 7 and bottle rail 8. A spin is imparted to each container 1 as it tangentially exits the star wheel 5 and bears against roll on pad 7. Once it is spinning, the container is ready for label application.

Vacuum drum 10, positioned in tangent with star wheel 5, carries to labeling position 15 a sequence of glued labels 20 on its surface. As spinning containers reach labeling position 15, labels are wrapped sequentially by contact between the unlabeled containers 1 and the glued leading edge 17 of the label 20 located on protrusion 11 of the vacuum drum 10. After a label is wrapped, the labeled containers 2 continue to spin as they exit onto the discharge conveyor 9.

As shown in FIG. 2, spinning and instability of the labeled containers which would otherwise limit the speed of operation of the apparatus are dampened by dual stabilizer belts 12 and 14. The belts, positioned in parallel along the container discharge path, are driven in opposing directions around posts 26 and press against the sides of the containers to prevent them from spinning. Belts 12 and 14 travel at approximately the same speed as discharge conveyor 9 in order to insure smooth container exit.

Stabilizer belts 12 and 14 are preferably constructed of a plurality of stacked round polyurethane belt members 13 The number of individual belt units on each stabilizer belt can be varied according to the height of containers to be processed on the apparatus. Tension member 21, placed along the belt path ensures proper belt tension.

Referring to the figures, the continuous preparation of label segments is hereinafter described. Label segments are formed by continuously feeding label stock 16 via a roll (not shown) to the vacuum drum 10. Pressure rollers (not shown) advance the stock through a cutter, which continuously severs predetermined lengths of label, while the leading edge 17 of the label 20 is held by suction onto protrusion 11 of vacuum drum 10.

Figure 3:
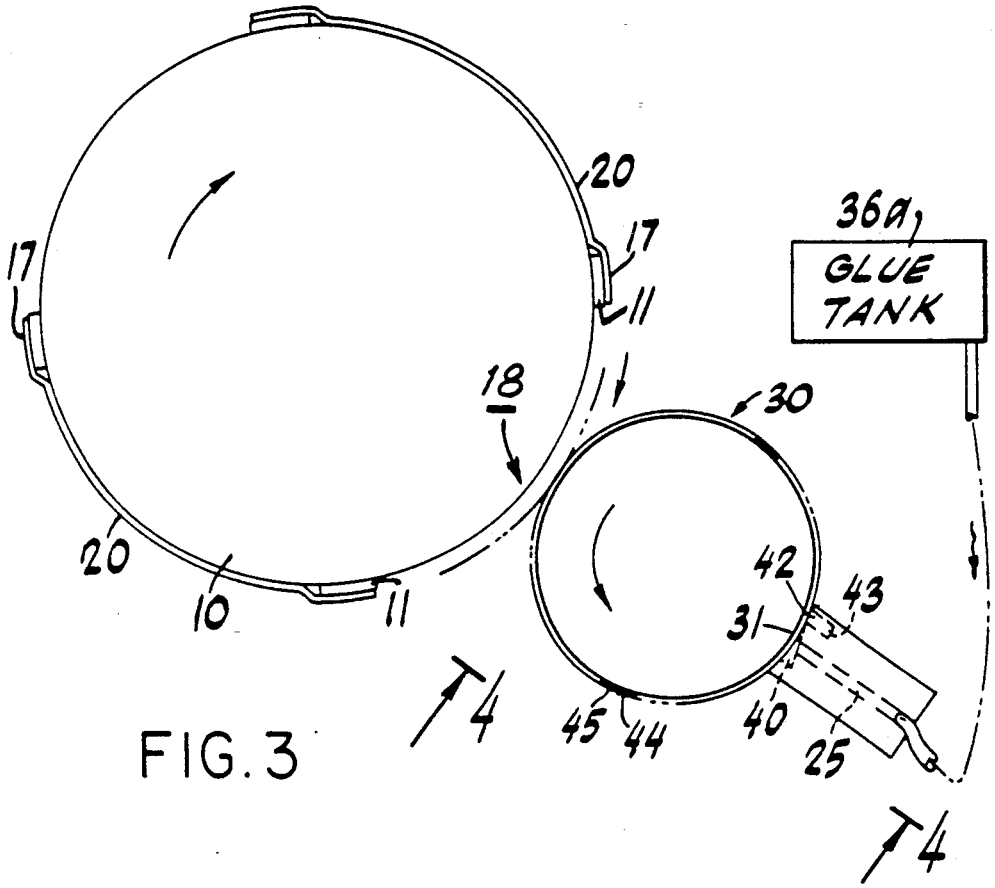
FIG. 3 is a top plan view of the glue roller and glue bar assembly.
Figure 4:
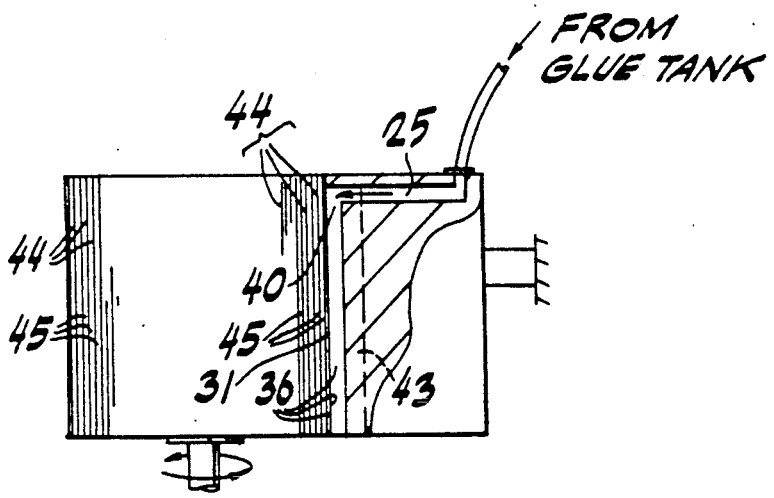
FIG. 4 is a side view along section 4—4 of FIG. 3 of the glue bar and glue roller.
Figure 2:
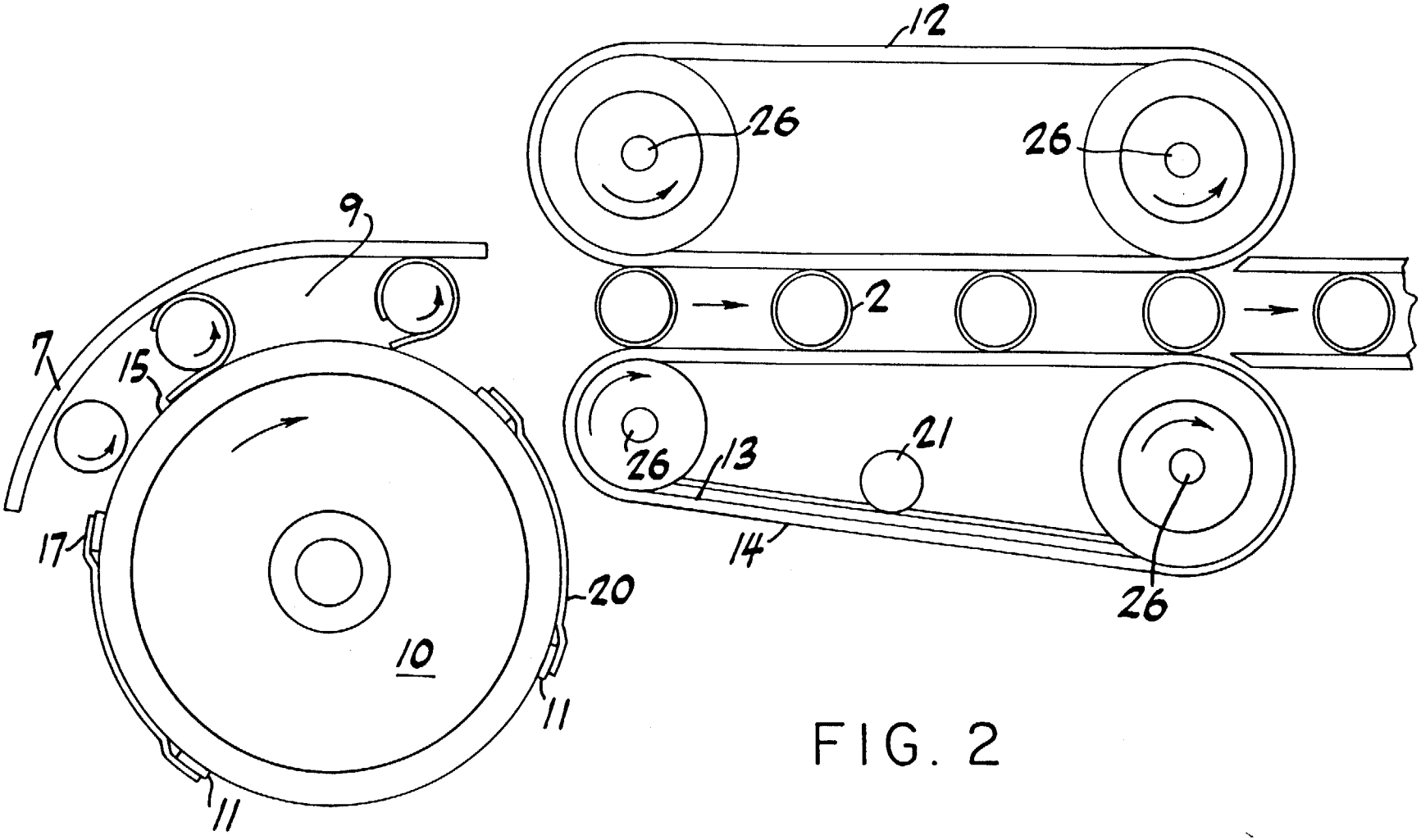

After each label segment 20 is cut, it is positioned on the surface of vacuum drum 10 and rotated through a glue printing position 18 where glue is printed onto the label by glue roller 30 as shown in FIGS. 3 and 4. Protrusions 11 on vacuum drum 10 act as platens for printing of the leading and trailing edges of the label segment. According to the invention, glue may alternatively be printed on only the leading edge of a label, leaving the trailing edge to be attached either to the container or to the leading edge by another means such as solvent or heat bonding.

The glue roller 30 as shown in FIGS. 3 and 4 receives glue from the face of a glue bar 31. Glue 36 is fed from glue tank 36A through internal glue channel 25 to the glue bar face 31 for application to the surface of rotating glue roller 30. Channel 25 leads to a triangular shaped, tapered opening 40 on the glue bar face 31. As glue enters tapered opening 40, the rotation of glue roller 30 causes build up of suitable pressures in the tapered configuration 40 so as to force glue into the patterned surface formed by grooves 44 between knurls 45 on the glue roll 30. Other patterns which result in a similar operation will be apparent to those of ordinary skill in the art.

FIG. 3 shows the taper to be an angle of 15°. This angle refers to the acute angle formed at the intersection of the downstream and phantom sidewalls of the triangular shaped opening. The invention may successfully create suitable pressures at other angles of taper between 5° and 45°. Taper 40 may also peak at a point which is offset from the centerline of glue channel 25. Alternative taper configurations develop varying patterns of pressuring glue into the knurled face of glue roller 30.

Excess glue collects in hollow 43. Edge 42, downstream of the tapered opening 40 on the glue bar face wipes and doctors off excess glue on the surface of glue roller 30 and collects it in vertically disposed hollow 43. The glue is spread by edge 42 and excess glue runs into hollow 43, where it may be collected for recirculation.

While this invention has been described in conjunction with its preferred embodiment, modifications may be made by those skilled in the art without departing from the spirit and scope of the invention as defined in the following claims.

What is claimed is:

1. Labeling apparatus for high speed application of labels to cylindrical containers comprising:

(a) a cylindrical rotary drum having a plurality of protrusions thereon and means for retaining a label on a face thereof such that an end of said label contacts the top of a protrusion;

(b) glue application roll means having a patterned surface for applying glue onto the ends of said label retained on said protrusions;

(c) a glue bar connected to a glue tank for applying glue to the surface of said glue application roll means through a tapered opening formed in a face of said glue bar which face addresses said glue application roll means (d) conveyor means for continuous container feed of cylindrical containers in rapid succession to said cylindrical rotary drum;

(e) means for imparting spin opposite to the direction of rotation of said cylindrical rotary drum to said containers at a label application station such that the ends of said labels contact a surface of said container and are applied thereto;

(f) a discharge conveyor for carrying said labeled containers in rapid succession from said label application station;

(g) independently mounted stabilizer belt means for dampening axial rotation of said labeled containers while supporting them in an upright position as they are discharged in a stabilized manner on said discharge conveyor.

2. Labeling apparatus as in claim 1 wherein the patterned surface of said glue application roll means is an alternating series of knurls and grooves.

3. An apparatus as described in claim 1 wherein said glue is hot melt glue.

4. An apparatus as described in claim 1 wherein said independently mounted stabilizer belt means comprises at least two oppositely rotating parallel belts which contact said labeled containers on opposite sides.

5. An apparatus as described in claim 4 wherein said parallel belts are constructed of a plurality of polyurethane belt members.

6. A method of applying labels in rapid sequence to cylindrical containers comprising the steps of:

(a) continuously transporting a rapid sequence of cylindrical containers toward a label application station;

(b) positioning a leading edge of a label segment on protrusions formed on the periphery of a vacuum drum;

(c) channeling glue through a vertically positioned glue bar including a face which abuts a glue application roll;

(d) depositing glue onto the glue application roll through a tapered portal on said face of said glue bar;

(e) spreading the glue evenly over the surface of the glue application roll; and, (f) collecting excess glue from the surface of the glue application roll in a recess in said glue bar face positioned orthogonal to the surface of the glue application roll;

(g) applying glue to said leading edge of the label segment by contacting said leading edge with the glue spread on the glue application roll;

(h) advancing the label segment to the label application station;

(i) imparting a spin to each container and thereby affixing the label segment to said container by allowing the container to contact said leading edge of said label segment at said label application station;

(j) rapidly discharging said containers in a stable, non-rotating upright condition by simultaneously supporting and dampening rotation of the containers about their axes.

7. The method of claim 6 wherein the steps of positioning and applying glue to said leading edge include the additional steps of positioning a trailing edge of a label segment on protrusions formed on the periphery of a vacuum drum and applying glue to said trailing edge of the label segment.

8. The method of claim 7 wherein the step of affixing the label segment to the container includes the additional step of affixing the trailing edge to said leading edge.

9. Labeling apparatus for high speed application of labels to containers comprising:

(a) means for continuously feeding and imparting spin to containers;

(b) a vertically positioned glue bar which receives glue at its uppermost end from a supply of same and deposits said glue, under pressure, through a tapered glue emission portal along its length onto a glue application roll means positioned in abutting relationship to said portal and containing a patterned surface;

(c) a rectangular hollow on said glue bar located adjacent said tapered glue emission portal and disposed orthogonal to the surface of said glue application roll for spreading deposited glue on the surface of said glue application roll means and collecting excess glue from the surface of said glue application roll means;

(d) a cylindrical rotary drum with vacuum means for retaining a label on its surface, which drum first brings an edge of said label into contact with the deposited glue on said glue application roll means, and secondly brings the label into contact with said continuously fed spinning containers at a label application station such that said label is applied to said container;

(e) discharge means for conveying said labeled container away from said label applying station;

(f) independently mounted oppositely rotating parallel stabilizer belts which receive said labeled containers from said discharge means and dampen axial rotation of said labeled containers while supporting them in an upright position.

10. Labeling apparatus as in claim 9 wherein said patterned surface of said glue application roll means is a series of alternating knurls and grooves.

11. Labeling apparatus as in claim 10 wherein said tapered glue emission portal peaks to a point which is offset from the centerline of said portal.

12. Labeling apparatus as in claim 10 wherein said tapered glue emission portal is triangularly shaped in ross section perpendicular to the axis of said vertically positioned glue bar.

13. Labeling apparatus as in claim 12 wherein said triangularly shaped tapered portal has a taper angle between 5° and 45°.

14. Labeling apparatus as in claim 13 wherein said triangularly shaped tapered portal has a taper angle of approximately 15°.

* * * * *

UNITED STATES PATENT AND TRADEMARK OFFICE

CERTIFICATE OF CORRECTION

PATENT NO. : 5,045,140

DATED : September 3, 1991

INVENTOR(S) : Daniel M. Dickey

It is certified that error appears in the above-identified patent and that said Letters Patent is hereby corrected as shown below:

The drawing sheet, consisting of Fig. 2, should be deleted to be replaced with the drawing sheet, consisting of Fig. 2, as shown on the attached page.

Signed and Sealed this

Thirteenth Day of April, 1993

*Attest:*

STEPHEN G. KUNIN

*Attesting Officer*

*Acting Commissioner of Patents and Trademarks*